US005755472A

United States Patent [19]

Clive-Smith

[11] Patent Number: 5,755,472

[45] Date of Patent: May 26, 1998

[54] FOLDING CARGO CARRIER WITH RAMP END

[76] Inventor: Martin Clive-Smith, 151 Broomwood Rd., London SW11 6JU, United Kingdom

[21] Appl. No.: 180,454

[22] Filed: Apr. 12, 1988

Related U.S. Application Data

[63] Continuation-in-part of Ser. No. 819,531, Jan. 16, 1986, abandoned.

[51] Int. Cl.[6] ..... B65D 19/12

[52] U.S. Cl. ..... 294/67.1; 108/53.1; 108/55.1; 294/904

[58] Field of Search ..... 294/67.1, 68.1, 294/68.3, 904; 108/51.1–56.3; 206/386, 595, 596, 598, 600; 220/1.5, 6, 7; 410/6, 52, 77, 83

[56] References Cited

U.S. PATENT DOCUMENTS

| | | | |
|---|---|---|---|
| 1,044,667 | 11/1912 | Lachman | 220/651 |
| 2,936,985 | 5/1960 | Doerr et al. | 108/55.1 |
| 3,480,174 | 11/1969 | Sherwood | 220/1.5 |
| 3,499,398 | 3/1970 | Murray | 108/53 |
| 3,568,608 | 3/1971 | Taylor et al. | 108/53.1 |
| 3,591,033 | 7/1971 | Partridge | 220/6 |
| 3,620,388 | 11/1971 | Mansson | 294/904 X |
| 3,626,872 | 12/1971 | Cully | 108/55.5 |
| 3,646,609 | 2/1972 | Bodenheimer | 220/1.5 |
| 3,735,713 | 5/1973 | Glassmeyer | 108/55.1 X |
| 3,753,407 | 8/1973 | Tilseth | 108/55.5 |
| 3,765,556 | 10/1973 | Baer | 220/1.5 |
| 3,874,546 | 4/1975 | Sanders | 220/6 |
| 4,015,710 | 4/1977 | Biggs | 108/55.5 |
| 4,099,640 | 7/1978 | Nessfield | 220/6 |
| 4,131,071 | 12/1978 | Glassmeyer | 108/53.1 |
| 4,162,737 | 7/1979 | Clive-Smith | 220/1.5 |
| 4,240,359 | 12/1980 | Howe | 108/53.1 |
| 4,309,013 | 1/1982 | Howe | 108/53.1 X |
| 4,319,732 | 3/1982 | Godfrey | 108/53.1 X |
| 4,353,520 | 10/1982 | Jansson | 108/55.1 X |
| 4,355,732 | 10/1982 | Nessfield | 108/55.3 X |
| 4,650,381 | 3/1987 | Durkin | 206/512 |
| 4,886,694 | 12/1989 | Donnard | 108/55.5 |
| 4,911,318 | 3/1990 | Bishop | 220/1.5 |
| 4,966,085 | 10/1990 | Howe | 108/55.1 |

FOREIGN PATENT DOCUMENTS

| | | | |
|---|---|---|---|
| 2513222 | 3/1983 | France | 206/600 |
| 113428 | 12/1968 | Norway | 108/55.1 |
| 674881 | 3/1949 | United Kingdom . | |
| 935189 | 8/1963 | United Kingdom . | |
| 939536 | 10/1963 | United Kingdom . | |
| 1258284 | 12/1971 | United Kingdom . | |
| 2055343 | 3/1981 | United Kingdom | 108/56.1 |
| 2073149 | 10/1981 | United Kingdom | 206/600 |
| 2097364 | 11/1982 | United Kingdom | 206/600 |
| 2120211 | 11/1983 | United Kingdom | 206/600 |
| 2170185 | 7/1986 | United Kingdom | 220/1.5 |
| 9001007 | 2/1990 | WIPO | 220/600 |

*Primary Examiner*—Johnny D. Cherry

*Attorney, Agent, or Firm*—Ware Fressola Van Der Sluys & Adolphson

[57] ABSTRACT

A platform based shipping container with folding endwalls which enable the empty container to be stacked up with a pile of similar folded containers for economical transport. There is a twistlock at each corner to interlock folded containers together and a top lift aperture at each corner to enable the pile to be lifted from above. At least one endwall can also fold outwardly away from the base to provide a ramp for the loading of vehicles. The endwalls are resiliently biased to provide for folding in either direction.

6 Claims, 10 Drawing Sheets

FOLDING CARGO CARRIER WITH RAMP END

This application is a continuation-in-part of applicant's prior application Ser. No. 819,531, filed Jan. 16, 1986, now abandoned.

BACKGROUND AND SUMMARY OF THE PRESENT INVENTION

This invention relates to the field of cargo carrier of a type commonly used in international shipping.

International shipping containers of the closed box type are not always suitable for certain cargoes which cannot fit inside the common container. In such instances, a platform based structure with two endwalls is often used.

When the platform-based container, sometimes called a flatrack, is empty, it is economically advantageous to be able to fold the endwalls down over the base, stack and lock a number of flatracks together and store or ship them as one unit. Several designs of folding wall flatracks can be seen around the world.

A number of important requirements must be satisfied in the folding flatrack to ensure that it is compatible with the full range of international freight containers. The endwalls must be accurately and robustly lockable in the erect position. When folded, there should be standard apertures at the corners for handling and securing by standarized handling equipment such as forklifts. It is also useful to have a means whereby folded flatracks can be interlocked not only with those of the same design but with others which incorporate standard handling apertures. A fourth useful feature is to have a counterbalancing system for the heavy endwalls, thereby enabling manual erection and folding of the endwalls.

Typical folding flatracks and their features may be seen in patent numbers of Great Britain 1217 334, Taylor and Howe; 2028 731, A. Merz; 1432 542, Howe; 52 531/67, Walker; and 1258 284, Nippon Kokan Kabushiki Kaisha.

One of the common cargoes of flatracks are vehicles where it is convenient to be able to drive the vehicle straight onto the flatrack. The normal method of loading is for the vehicle to maneuver onto the platform from the open side but this takes time and absorbs cargo space. Pallets such as described by Nippon Kokan Kabushiki Kaisha with ramp ends provide a solution for small vehicles but do not provide the essential features for intermodal transport of freight containers. Futhermore, industrial and military vehicles are at least as wide if not wider than the platform and ramp so that there is no room for the highly projecting hinge posts of NKKK nor space for the large side structures.

According to the present invention, there is a folding flatrack which has endwalls which are lockable in the erect position and which can fold down onto the platform base, and which can fold outwardly to provide a ramp to enable overwidth vehicles to drive onto the platform base. The invention also provides a means whereby the heavy endwalls can be counterbalanced throughout movement inwardly and outwardly; and, when the walls are folded, a means to interlock a plurality of folded flatracks together and enable handling with standardized handling equipment through the provided apertures. The endwalls and the vehicle-supporting base are free of upwardly extending projections across the widths thereof such that over-width vehicles freely move onto the ramp and base without interference. A specific embodiment of the invention will now be described by way of example with reference to the accompanying drawings in which:

DETAILED DESCRIPTION OF A PREFERRED EMBODIMENT

Figure 1:
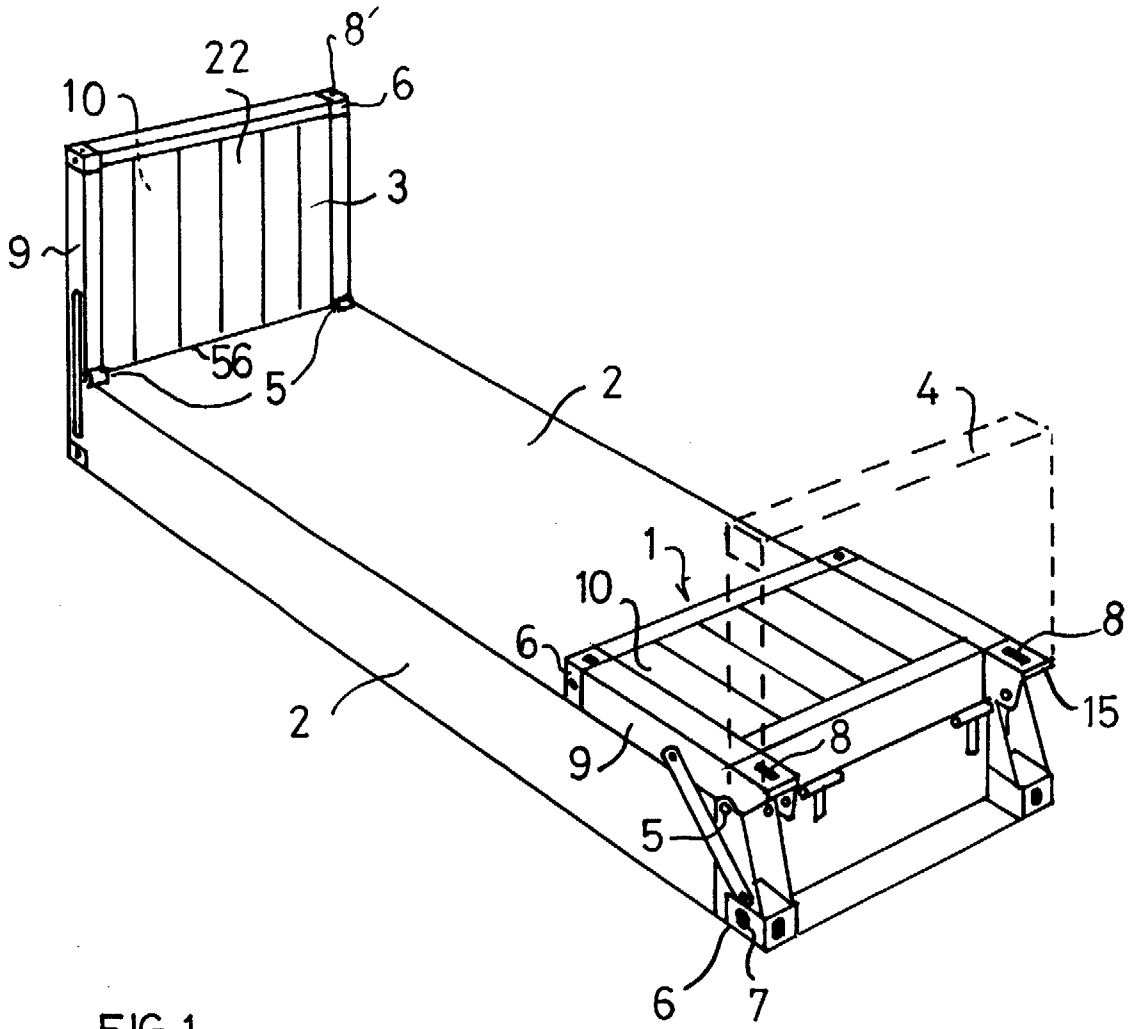
FIG. 1 is a perspective view of a folding flatrack with the near end folded down across the base.

Referring now to FIG. 1, a folding flatrack is shown with one endwall 1 folded onto the base 2. The other endwall 3 remains erect and the dotted line 4 shows the erect position of endwall 1. The endwalls 1, 3 are connected pivotally at pins 5 to the base 2. At each of the bottom corners of the base 2 and the top corners of the endwalls 1, 3 there are rectangular boxes 6 usually manufactured from cast steel which have handling apertures 7 formed in their sides. When the endwall 1 is folded as shown, a further handling aperture 8 is provided in the now horizontal surface plate 15 of the endwall 1 which is equivalent to top aperture 8' in box 6. When both endwalls 1, 3 are erect, cargo may be placed on the base 2 for transport.

Typically, the base 2 and endwalls 1, 3 are constructed of steel with the base 2 being decked with timber or steel. The endwalls 1, 3 comprise corner posts 9 and panel 10 to form a complete structure.

Figure 2:
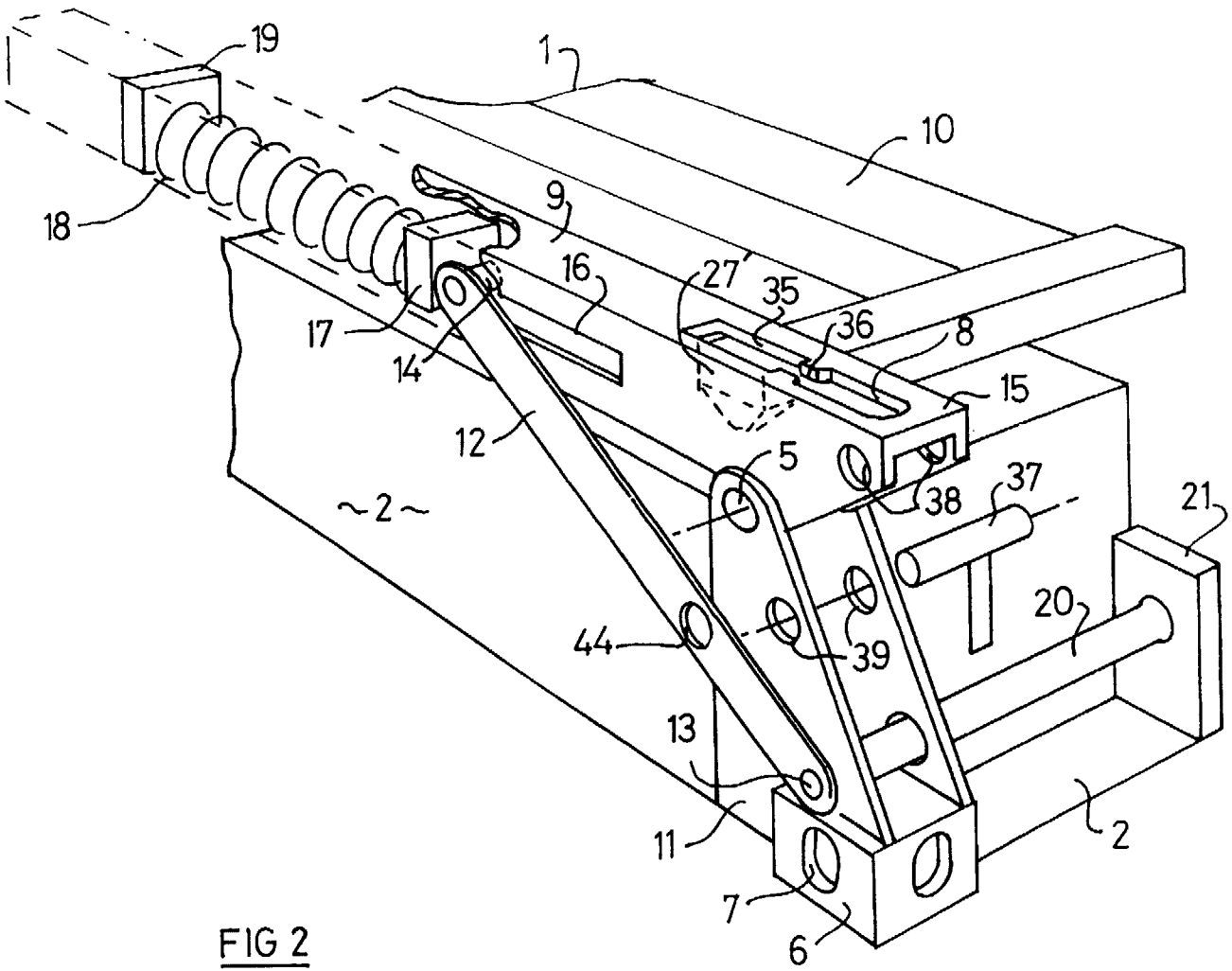
FIG. 2 shows an enlarged view of the folded corner arrangement.

FIG. 2 shows an enlargement of the folded corner of endwall 1. A support 11 is attached rigidly to the base 2 through which passes the pin 5. A rod 12 is pivotally attached to the support 11 by pin 13 at one end. At the other end, rod 12 is slidingly connected to corner post 9 by keeper 14 which slides within slot 16 made in the side of post 9. Inside the corner post 9 slides a block 17 which on one side is driven by keeper 14 and on the opposite side acts on one end of a compression spring 18.

The other end of the spring 18 is supported by a block 19 fixedly mounted within the corner post 9. In this position the spring 18 is compressed between the blocks 17, 19. This compression acts on the blocks 17, 19 and thence to the rod 12 and base pin 13 causing a reaction between the post 9 and base 2 which urges the corner post 9 and endwall 1 upwards towards the vertical. In practice, the strength of the spring 18 is selected to provide a force to balance the weight of the endwall 1 and thus assist raising of the endwall 1.

Figure 3:
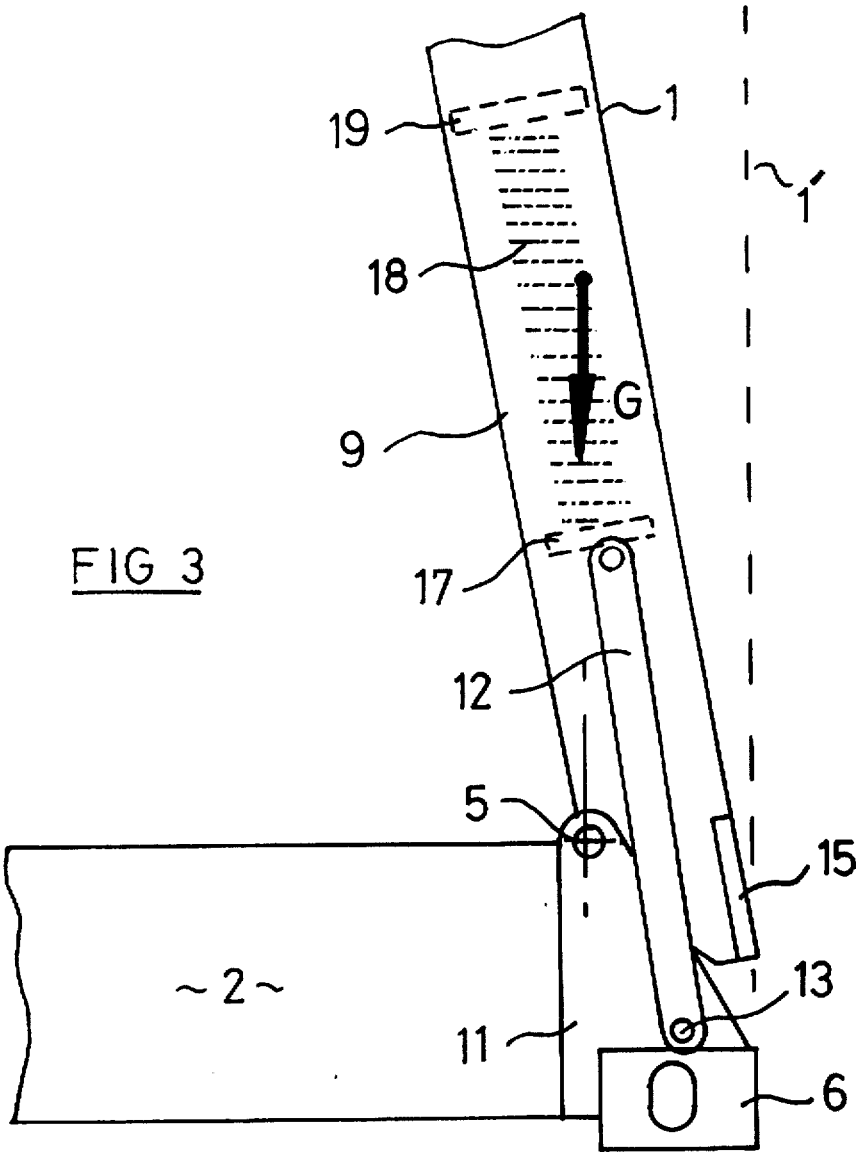
FIG. 3 shows a side elevation of part of the flatrack with the endwall almost erect.

Continuing with the working of the spring 18, in FIG. 3, the corner post 9 is almost erect and by the nature of the geometry, the blocks 17 and 19 move apart from one another. The free length of the spring 18 is selected so that in this position, where the center of gravity and weight of the endwall 1, signified by arrow G, is balanced by acting through the pivot pin 5, there is no compression in the spring 18.

Figure 4:
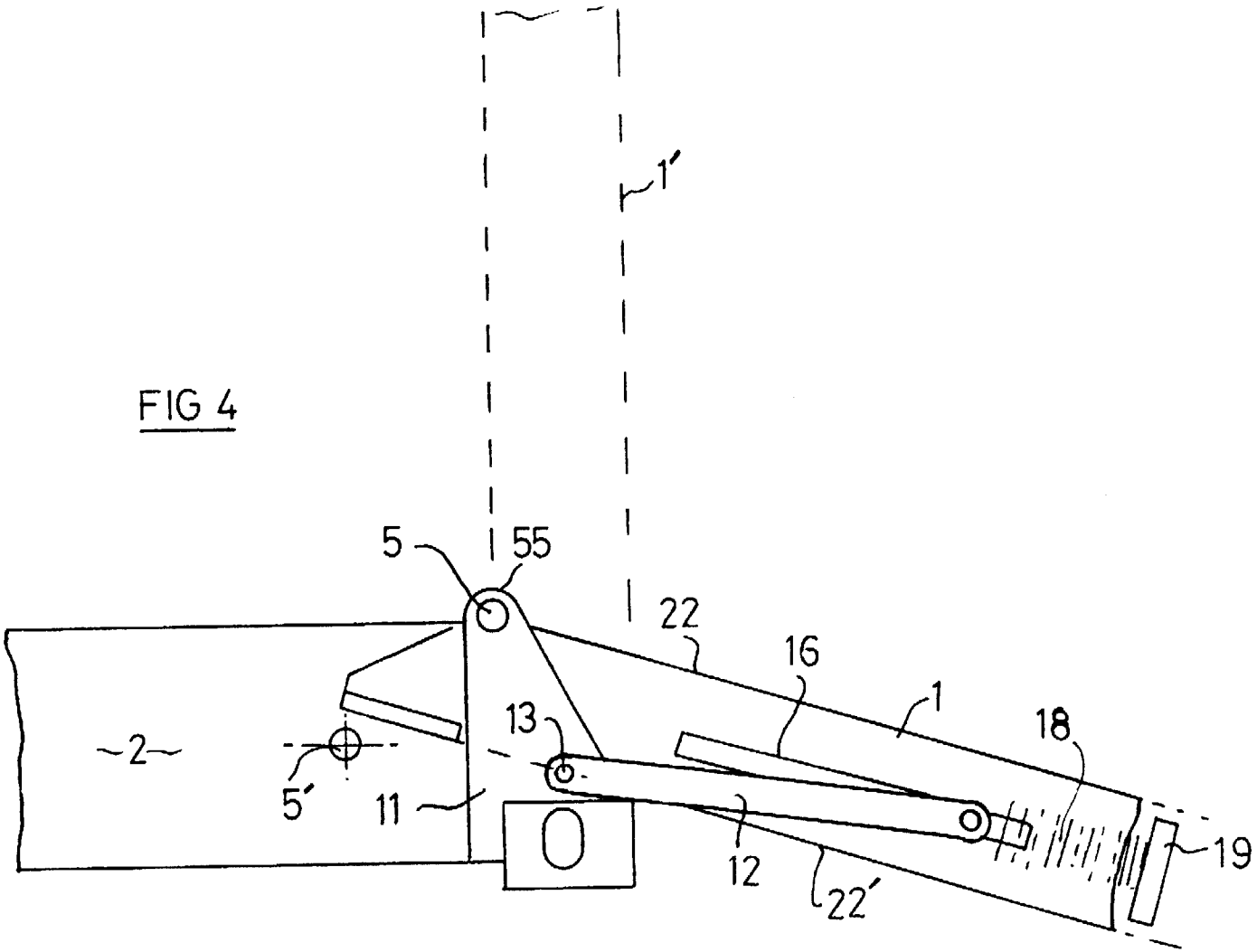
FIG. 4 shows the same view as FIG. 3 but with the endwall lowered outwardly in the ramp position.

In FIG. 4, the endwall 1 has rotated beyond the erect position 1' and because of the nature of the geometry, the rod 12 has rotated thereby sliding the keeper 14 and block 17 towards the block 19 and causing the spring 18 to become compressed again. As before, the compression in spring 19 urges the corner post 9 and thus endwall 1 towards the erect position 1' and assists in the raising of the endwall.

Figure 5:
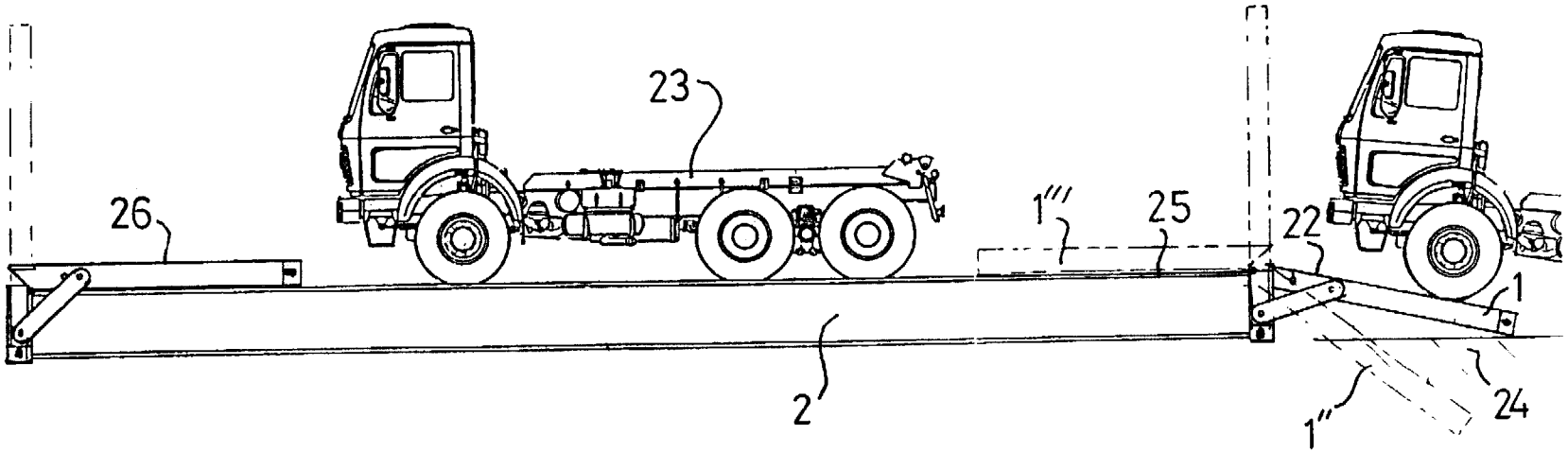
FIG. 5 shows a side elevation of the whole flatrack with vehicles using the ramp end.

In FIG. 5, the inner surface 22 of the endwall 1 is formed from a robust material such as wood or steel so as to be able to support a vehicle 23 which might be driven up onto the base 2. A similar surface might be provided in the outer surface 26 to support cargo when folded. The endwall 1 in operation may be lowered onto the ground 24 or to a position 1" some way below the base 2. The surface 22 is closely in line with the base surface 25 so that a substantially continuous path for the vehicle may be made from ground 24 to base 2. To achieve such a path and to eliminate or minimize projections above the surfaces 25, 22, the position of the pivot pin 5 is selected consistent with the requirement of the endwall 1 to fold down onto the base 2 shown in dotted line 1'".

As can be seen from FIG. 4 the projection 55 above pin 5 is very small compared to vehicle 23 seen in FIG. 5. To further minimize the projection 55, the pin 5 may be lowered to say 5' but this requires a lowering of surface 22 of the wall 1 when seen in ramp position, possibly as far as 22'. Hence, there is a step between surface 22' and the base 2. It is anticipated that such a step could be bridged by an additional ramp structure either hingedly attached to the base 2 of wall 1 or as a separate structure from the container.

Alternatively, the diameter of the pin 5 might be reduced by changes in structure and locking devices or by extending along the width of the base such as indicated by line 56 in FIG. 1.

Figure 6:
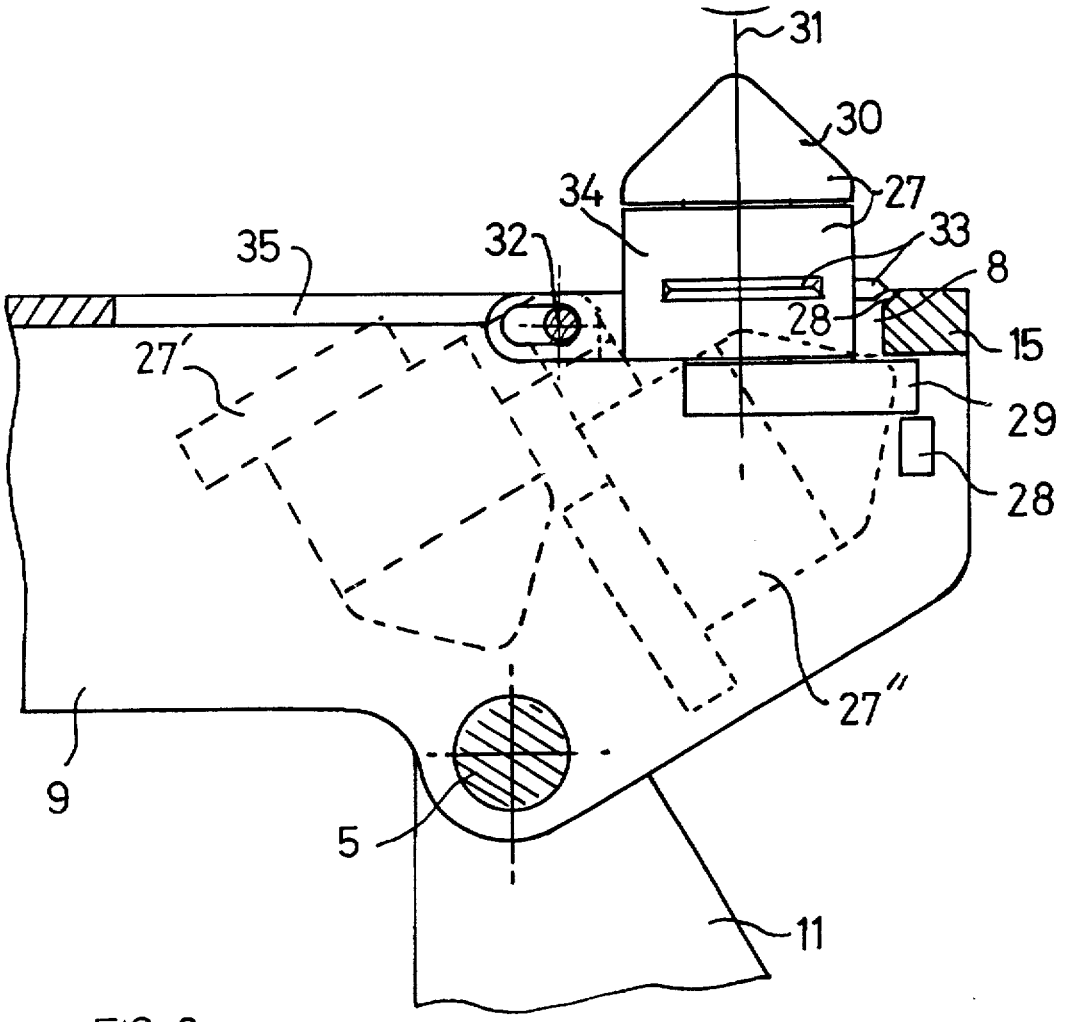
FIG. 6 shows a sectional view through the corner arrangement in the folded position revealing the twistlock arrangement.

Returning to FIG. 2, a twistlock 27' may be seen in dotted line mounted within the corner post 9. In FIG. 6, the twistlock 27 is seen in a raised position ready to receive another flatrack corner box 6 placed onto it. The locking of twistlock 27 is by rotation of a handle 29 in a horizontal plane through 90 degrees to cause the rotation of the head 30 on axis 31.

The twistlock 27 is pivotally attached to the post 9 by pin 32 and can rotate out through slots 35, 36 and into the aperture 8. Fins 33 are provided as part of the collar 34 acting on the plate 15 seated within a peripheral chamber 28 thereby supporting the twistlock 27 in the projection position shown.

The twistlock 27' in the stowed position is free to swing about its pivot pin 32 so that any device entering the aperture 8 would displace the twistlock 37' and be allowed free movement itself within and below the aperture 8.

The pivot pin 32 and its attendant holes in the plate 15 and twistlock 27 may be provided with large clearances so that when the corner post 9 is erect, the twistlock 27 falls to position 27" in the lower part of the aperture 8 and thus is retained within the plate 15.

To lock the endwall 1 in the vertical position, a number of known systems may be used such as a horizontally sliding pin 37. In FIG. 2 there may be seen two holes 38, 39 in the corner post 9 and support 11, respectively. When the corner post 9 is erected to position 1' in FIGS. 3 and 4, the holes 38, 39 come into alignment. A pin 37 may then be passed through the holes thereby securing the post 9 against further rotation in either direction.

Figure 7:
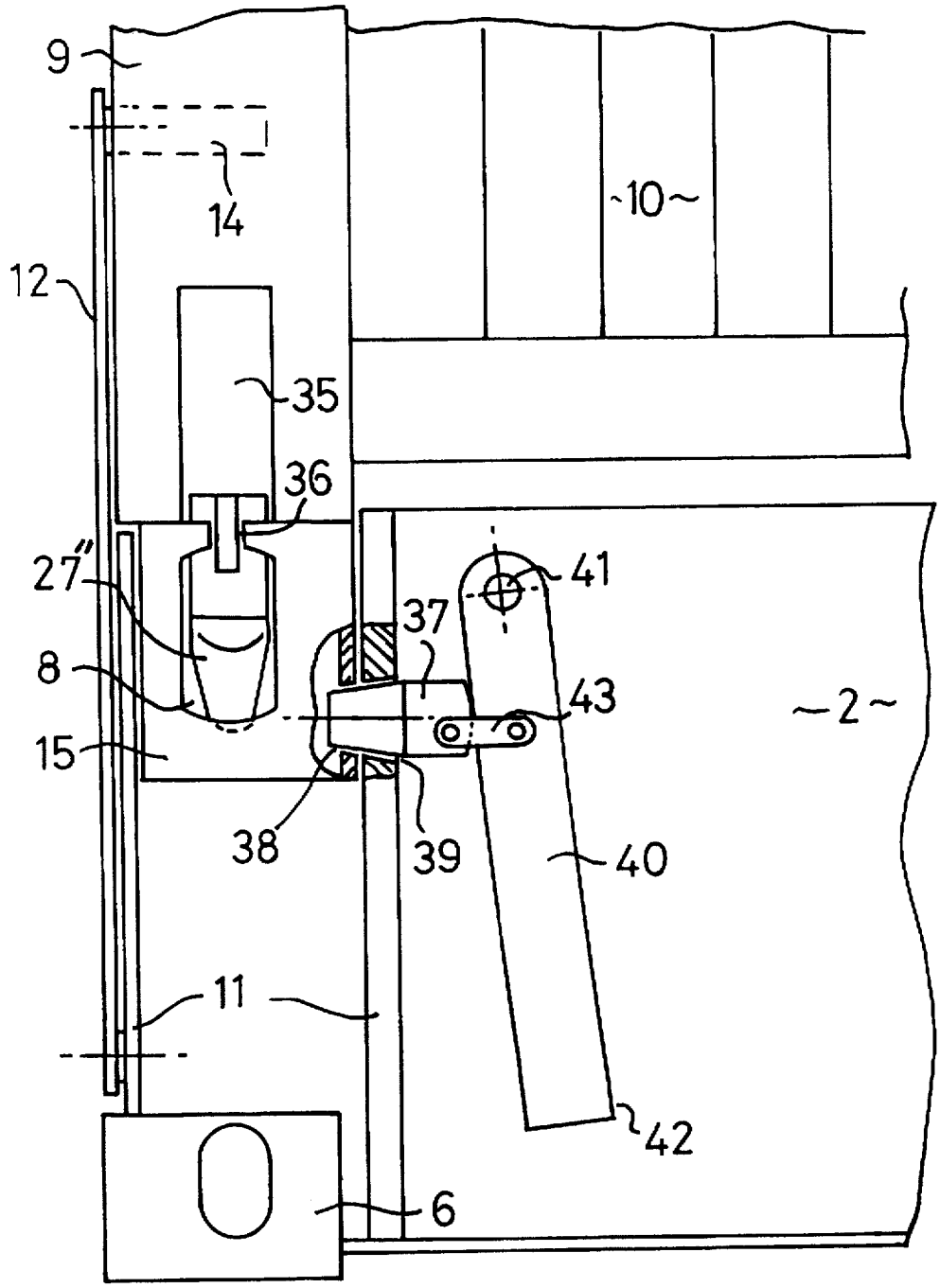
FIG. 7 shows an end elevation partly cut away, of one lower corner and a suitable locking mechanism.

The pin 37 may be conically shaped, wedge shaped, rectangular or cylindrical with correspondingly shaped holes 38, 39 and be assisted in its entering and withdrawal from the holes 38, 39 by additional means such as a shock hammer, lever, cam, screw and other means. A preferred system is shown in FIG. 7 where a handle 40 is pivotally mounted on the base 2 by pin 41. The locking pin 37 may be driven into engagement with the holes 38, 39 in the corner post 9 and support plate 11 by applying force by impact or steady pressure at the end 42 of the handle. A mechanical advantage results from the distance between pin 41, pin 37 and the handle end 42. To withdraw the pin 37, the pin 37 may be linked to the handle 40 by some means such as a link 43.

In another arrangement, when endwall 1 is in the erect position 1', the endwall 1 is folded outwardly to form a ramp by withdrawing the pivot pin 5 from engagement with the cornerpost 9 so that the endwall 1 pivots about a circular section locking pin 37.

In another arrangement, the pivot pin 5 may slide further into engagement with a hole 44 in the rod 12 thereby locking the post 9 in the erect position without need of the pin 37.

In an alternative arrangement, the spring 18 is substituted by a torsion spring 20 keyed into the rod 12 at pin 13. The torsion spring 20 is pivotally mounted through support 11 and anchored to the base 2 at block 21. As the rod 12 rotates in either direction from the position shown in FIG. 3, the spring 20 is resiliently biased, thereby urging the corner post 9 towards the vertical.

In a further arrangement, the spring 18 is arranged to act in tension rather than compression by mounting a rod (not shown) through its center attaching the rod to the upper end of the spring 18 and the lower end to the block 17.

It is anticipated that the endwall 1 may not be a continuous surface but comprise an open structure to suit the vehicles or loading requirements. The open structure may be such as to allow independent movement of the corner posts 9 from the panel 10 or surface 22.

Figure 8:
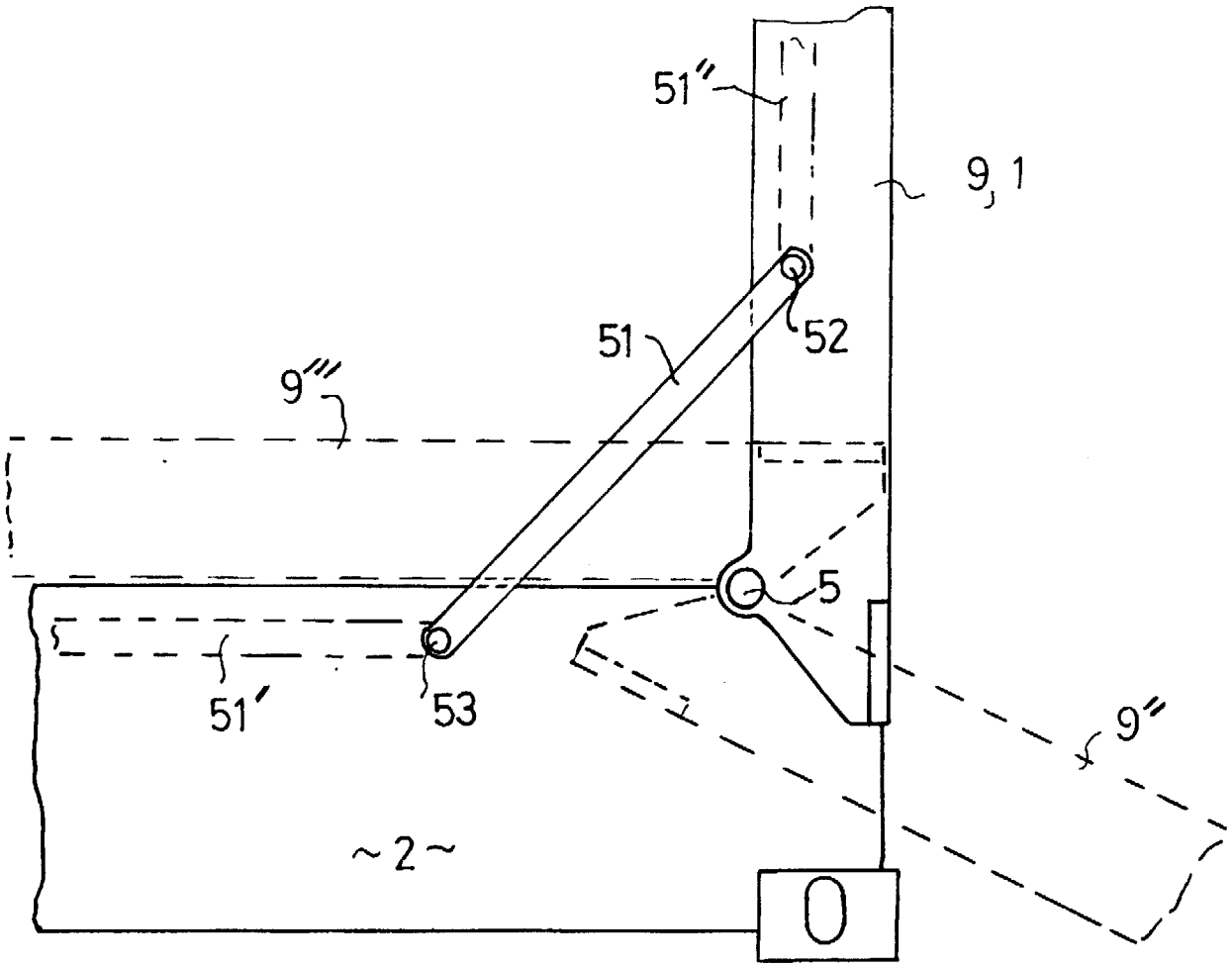
FIG. 8 shows a side elevation of a lower corner in which a hinged stay is used to support the corner post.

In FIG. 8, a further arrangement is seen in which a stay 51 is pinned to the corner post and base 2 by pins 52 and 53, respectively. In the position shown, the stay 51 locks the corner post 9 into an erect position. To allow the post 9'" to fold onto the base 2 or out to the ramp position 9" about its pivot 5, the pin 52 may be released from the post 9 and stay 51. The stay 51 may then be folded down to the base 2 to position 51'.

Alternatively the pin 53 may be released from the base 2 and stay 51. The stay 51 may then be stowed in the endwall 1 in position 51" and again the post 9 is free to be folded to positions 9" and 9'".

Figure 9A:
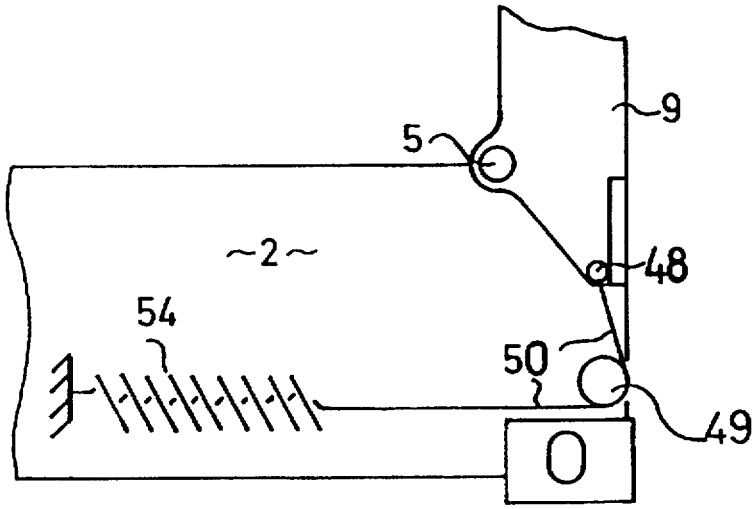
FIGS. 9A, 9B and 9C show a side elevation of a lower corner and details of a counterbalance spring system in three operation positions.

In FIG. 9A, an alternative counterbalance system is illustrated in which a spring 54 is anchored to the base 2. At the other end of the spring 54 a flexible linkage 50 comprising a steel wire, chain or the like, is attached to the free end of spring 54. The linkage 50 passes over a guide or wheel 49 mounted on the base 2. The linkage 50 is pinned to the post at pin 48. In the erect position of the post 9 as shown, there is minimal tension in the spring 54.

Figure 9B:
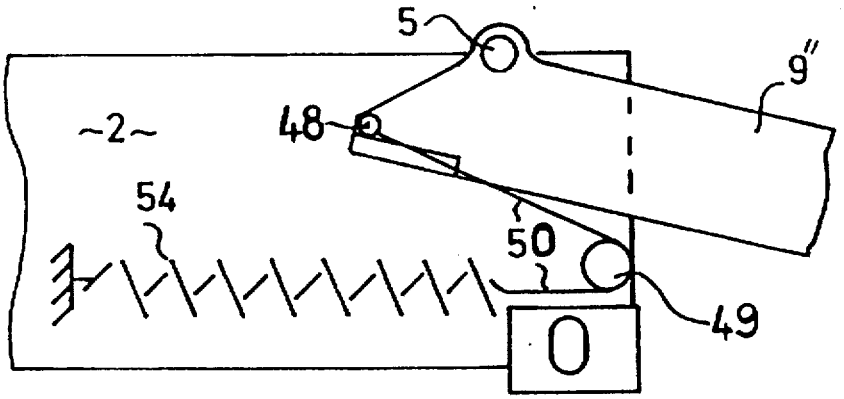

In FIG. 9B, the post 9 is folded to ramp position 9" and in doing so the pin 48 has been displaced about the corner post pivot pin 5 which in doing so draws the linkage 50 past the pulley 49 thereby biasing the spring 54. The tension in the linkage 50 tends to urge the post 9" upwardly to the erect position 9.

Figure 9C:
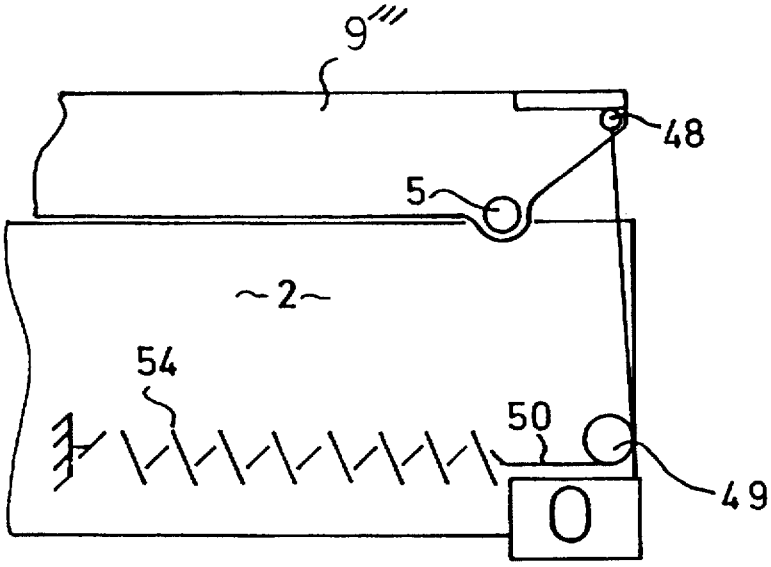

In FIG. 9C, the folded post 9'" has similarly displaced the pin 48, drawn the linkage 50 and biased the spring 54 producing tension in the linkage 50 which urges the post 9 up towards the erect position 9.

In an alternative arrangement, the linkage 50 passes through the center of the spring 54 and is anchored to the left-hand end. The right-hand end of the spring 54 is supported ported on the base 2 and the spring 54 now acts in compression.

Figure 10:
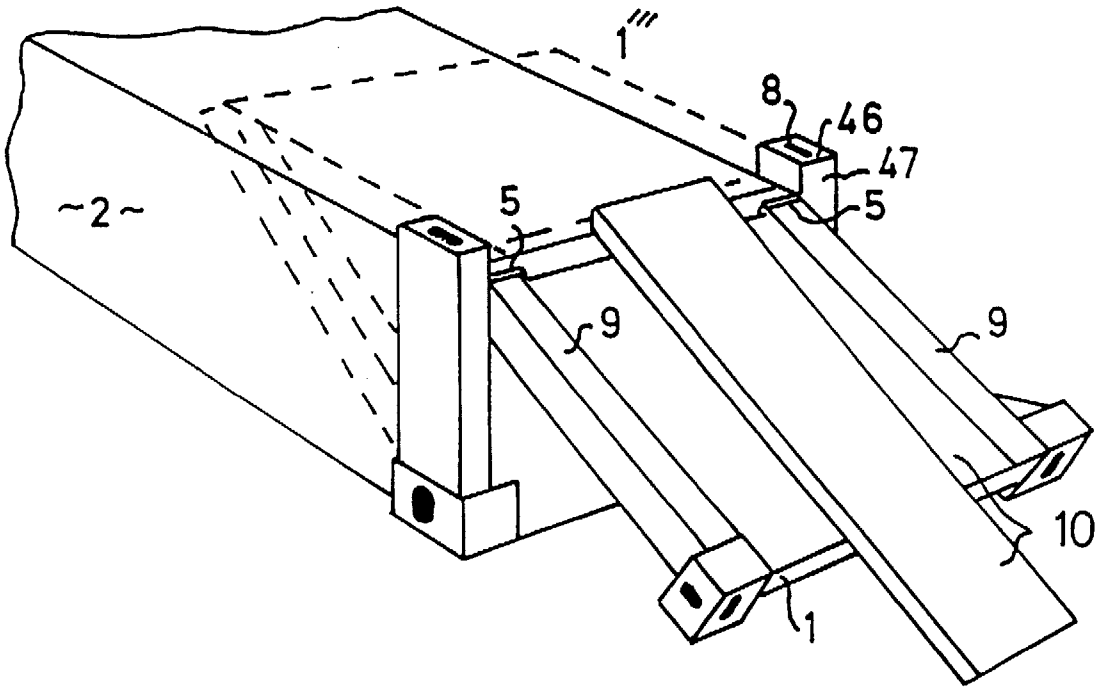
FIG. 10 shows a perspective view of an alternative ramp configuration.

In FIG. 10, another arrangement of handling aperture may be seen. The endwall 1 and posts 9 are pivoted to the base 2 at pin 5. At the corner of the base 2 there is a stub post 47 which is rigidly attached to the base 2. At the top of the stub post 47 is a plate 46 having formed in it a handling aperture 8. When the wall 1 is folded down onto base 2 as shown in dotted line, the plate 46 is just higher than the surface 10 of the wall 1. When the wall 1 is in the ramp position, the stub posts 47 project above the ramp surface 10.

In a further embodiment, it is anticipated that the locking device for holding corner post 9 in the erect position may interact with an abutment. However, for the corner post 9 to fold outwardly to the ramp position, it is anticipated that the abutment may itself be a releasable locking mechanism. It is also anticipated that many other known locking systems may be used to lock the endwall 1 in the erect position, which locking systems typically use twistlocks, pins of all profiles in any number of orientations, wedges, latches and hooks.

What is claimed is:

1. A platform based cargo carrier having:

a base having an upper surface;

and at least one end wall pivotally attached to said base; wherein said wall has;

means for locking said wall in a substantially vertical position;

means when unlocked for being folded inwardly towards said base and for being folded outwardly away from said base to form a ramp leading to said base;

and opposing first and second surfaces wherein said first surface faces said base when said wall is folded inwardly onto said base and said second surface faces away from said base;

and wherein said first surface of said wall is free of upwardly extending projections across the full width thereof; and said carrier further includes;

means for interlocking a plurality of said carriers together when said end wall is in an inwardly folded position;

wherein said interlocking means comprises:

an elongated aperture formed within said second surface of said wall, facing away from the base;

a slot in the wall surface adjacent said aperture:

and a twistlock which is loosely and pivotally mounted to said wall within said slot adjacent said aperture such that when said wall is folded down onto the base said twistlock can be pivoted through the slot and inserted into said aperture.

2. A carrier according to claim 1 in which said carrier includes a resilient biasing means for biasing said wall towards a vertical position, said biasing means being mounted within said carrier and having two ends, and being connected at one end to said wall and connected at the other end to said base by a toggle connection, whereby said resilient means is resiliently deformed in the same direction by pivoting folding movement of said wall away from said vertical position, both clockwise and counterclockwise, and said resilient means is resiliently relaxed by movement of said wall toward said vertical position, both clockwise and counterclockwise.

3. A carrier according to claim 2 in which the resilient biasing means comprises at least one helical coil spring arranged to bias said wall towards a vertical position.

4. A carrier according to claim 3 in which said resilient biasing means comprises a flexible linkage anchored at one end to an anchor point on the wall and from there passing round a guide located below the anchor point, said linkage then being connected to one end of said helical coil spring; the other end of said spring being anchored to said base.

5. A carrier according to claim 1 further comprising a pivotal attachment attaching said wall to said base, said pivotal attachment having a pivot axis extending along the juncture of the upper surface of said base and said first surface of said wall.

6. A carrier according to claim 1 in which the base has four corners and a stub post at each said corner, each said stub post including a top lift aperture for handling the container when said walls are folded onto said base.

* * * * *